US005467489A

United States Patent [19]

Cchen

[11] Patent Number: 5,467,489

[45] Date of Patent: Nov. 21, 1995

[54] AIR PERMEABLE CUSHION

[76] Inventor: Cchung-Pao Cchen, No. 184, Yung-Feng Rd., Chien-Chen Dist., Kaohsiung City, Taiwan

[21] Appl. No.: 184,842

[22] Filed: Jan. 21, 1994

[51] Int. Cl.[6] ..... A47C 27/04

[52] U.S. Cl. ..... 5/475; 5/468; 297/180.16; 297/DIG. 8

[58] Field of Search ..... 5/475, 477, 468, 5/469, 452, 453; 297/180.16, DIG. 8

[56] References Cited

U.S. PATENT DOCUMENTS

| | | | |
|---|---|---|---|
| 2,878,012 | 3/1959 | Crites | 297/DIG. 8 |
| 3,144,270 | 8/1964 | Bilancia | 297/180.16 |
| 4,868,941 | 9/1989 | Tai | 5/475 |

*Primary Examiner*—Alexander Grosz
*Attorney, Agent, or Firm*—Baker & Botts

[57] ABSTRACT

An air permeable cushion includes a base plate with several holes formed therethrough, several spring units erected on the base plate, and a covering made of an air permeable cloth and enveloping the spring units therein. Each of the spring units includes a bellows tube and a coiled compression spring mounted within the bellows tube. The bellows tube has a bottom wall abutting against the base plate and provided with a check valve that is communicated with a corresponding hole of the base plate in order to prevent air in the bellows tube from flowing out of the same through the bottom wall while permitting air to flow from the corresponding hole of the base plate into the bellows tube through the valve, a top wall abutting against the covering and having several holes formed therethrough, and an accordion-like peripheral wall interconnecting the top and bottom walls so that, when pressure is applied on the covering, the bellows tube contracts, thereby causing air to flow through the covering via the holes of the top wall. When the pressure applied on the covering is released, the bellows tube expands by action of the spring, thereby sucking in air via the valve and the holes of the top wall.

5 Claims, 3 Drawing Sheets

AIR PERMEABLE CUSHION

BACKGROUND OF THE INVENTION

1. Field of the Invention

This invention relates to an air permeable cushion, more particularly to an air permeable cushion which has several spring units mounted therein so as to blow air out through the covering of the cushion when a user lies on the cushion, and so as to suck in air through the base plate of the cushion when the pressure applied on the cushion is released, thereby permitting a circulation of air within the cushion for the user.

2. Description of the Related Art

Referring to FIG. 1, a conventional cushion 1 includes a horizontal base plate 10, a plurality of coiled compression springs 11 which are erected on the base plate 10, and a covering 12 which covers the coiled compression springs 11 so as to envelop the same therein. The covering 12 is composed of several layers of cloth or pads in order to provide a user with a comfortable feeling when he or she lies, sits or rests on the cushion 1. However, because the covering 12 is made up of several layers of cloth or pads and envelops all sides of the cushion 1, the inner portion of the cushion 1 is airtight during use. As a result, the user may feel hot and uncomfortable resulting from sweating of the body when the conventional cushion 1 is in use.

SUMMARY OF THE INVENTION

The main objective of this invention is to provide an air permeable cushion which has several spring units mounted therein so as to blow air out through the covering of the cushion when a user lies, sits, or rests on the cushion, and so as to suck in air through the base plate of the cushion when the pressure applied on the cushion is released, thereby permitting a circulation of air within the cushion for the user.

According to this invention, an air permeable cushion includes a horizontal base plate, a plurality of spring units which are erected on the base plate, a plurality of flexible U-shaped connection rods each of which interconnects an adjacent pair of the spring units so as to position the spring units on the base plate, and an upper covering which is disposed on the spring units and which envelops the spring units therein. The base plate has several holes formed therethrough. The covering is made of an air permeable cloth. Each of the spring units includes a bellows tube and a coiled compression spring which is mounted within the bellows tube. Each of the bellows tubes is made of a flexible material and has a horizontal bottom wall which abuts against the base plate, a horizontal top wall which abuts against the covering, and an accordion-like peripheral wall which interconnects the top and bottom walls. The bottom wall of each of the bellows tubes has a check valve communicating with a corresponding one of the holes of the base plate in order to prevent air in the bellows tube from flowing out of the same through the bottom wall while permitting air to flow from the corresponding one of the holes of the base plate into the bellows tube through the check valve. The top wall of each of the bellows tubes has several holes formed therethrough so that, when pressure is applied on the covering, the bellows tubes contract, thereby causing air to flow through the covering via the holes of the top wall. When the pressure applied on the covering is released, the bellows tubes expand by the action of the coiled compression spring, thereby sucking in air via the check valve of the bottom wall and the holes of the top wall.

BRIEF DESCRIPTION OF THE DRAWING

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
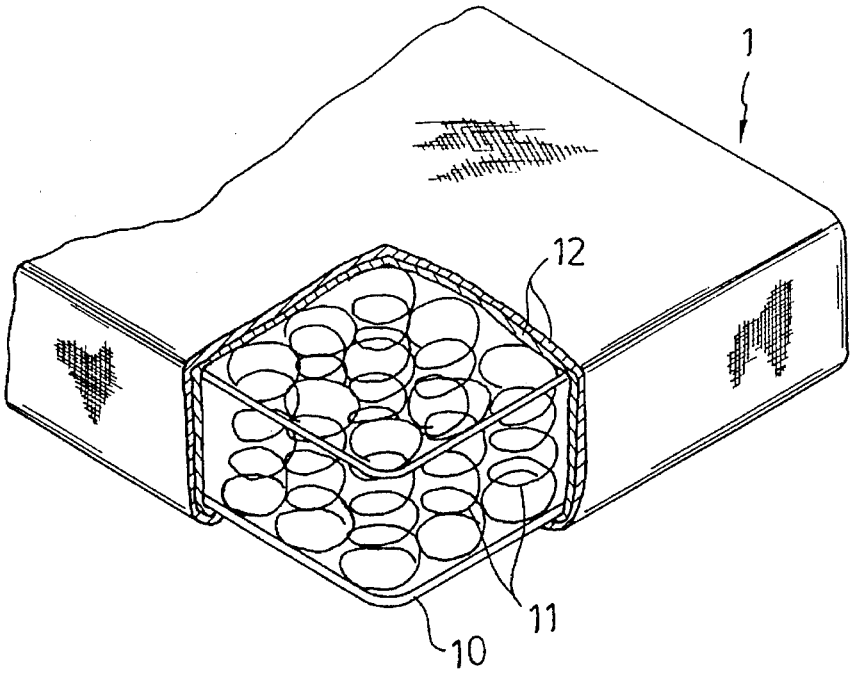
FIG. 1 (PRIOR ART)
FIG. 1 is a partially sectional perspective view showing a conventional cushion.
Figure 2:
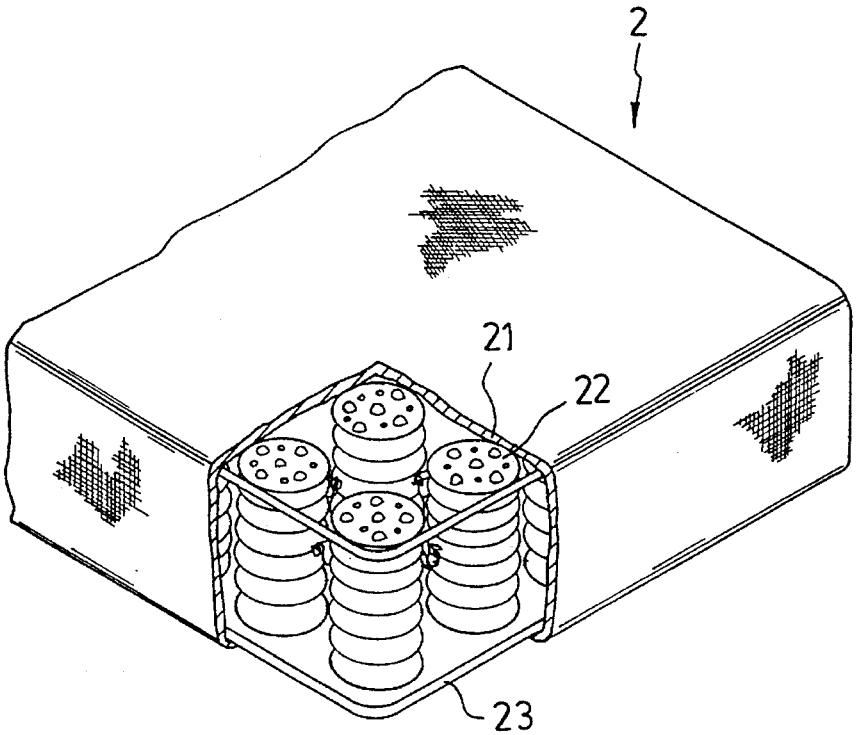
FIG. 2 is a partially sectional perspective view showing an air permeable cushion of the first embodiment of this invention.

Referring to FIG. 2, an air permeable cushion 2 of the first embodiment of this invention includes a horizontal base plate 23, a plurality of spring units 22 which are erected on the base plate 23, and an upper covering 21 which is disposed on the spring units 22 and which envelops the spring units 22 therein.

Figure 3:
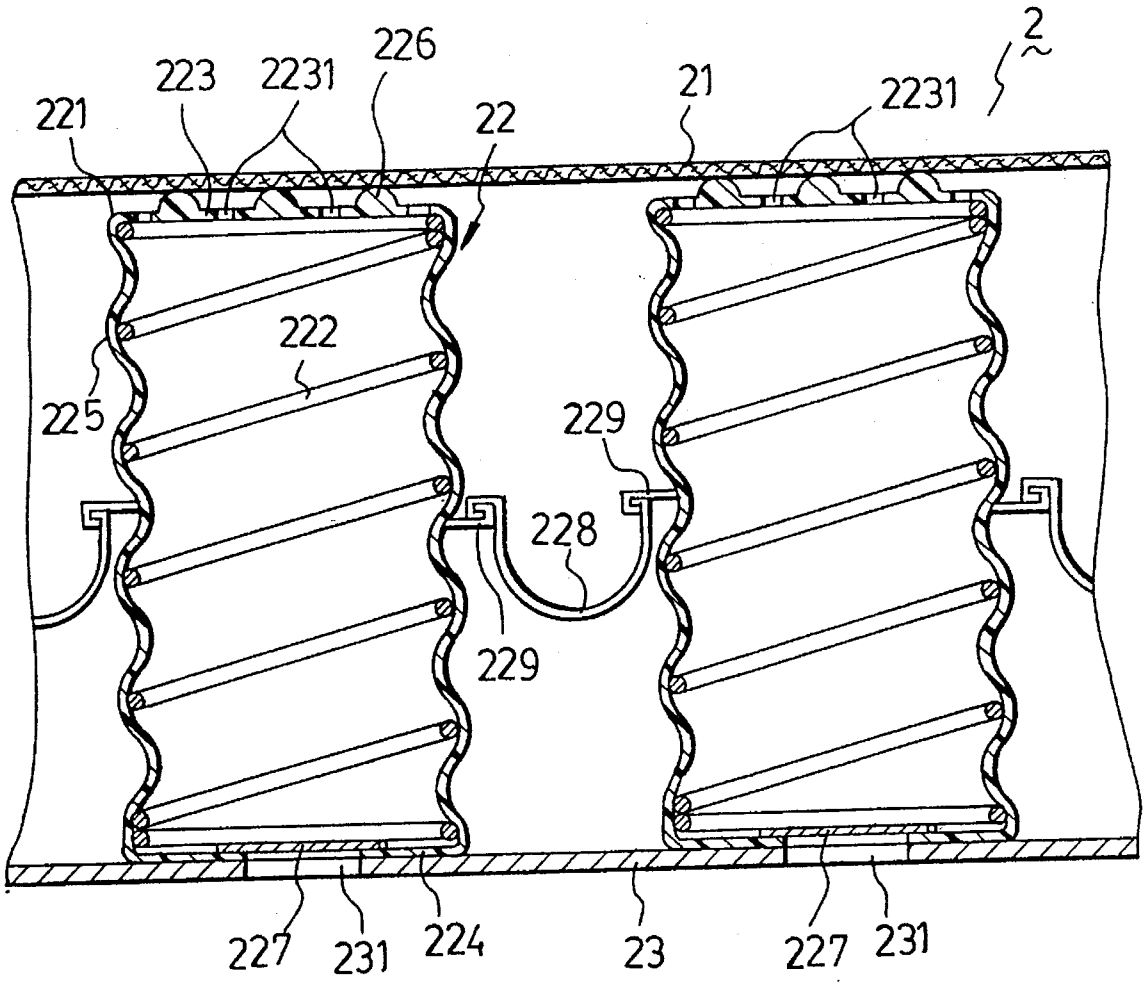
FIG. 3 is a sectional view showing the first embodiment of the air permeable cushion of this invention.

Referring to FIG. 3, the base plate 23 has several holes 231 formed therethrough. The covering 21 is made of an air permeable cloth. Each of the spring units 22 includes a bellows tube 221 and a coiled compression spring 222 which is mounted within the bellows tube 221. Each of the bellows tubes 221 is made of flexible material and has a horizontal top wall 223, a horizontal bottom wall 224 which abuts against the base plate 23, and an accordion-like peripheral wall 225 which interconnects the top and bottom walls 223, 224. The top wall 223 of each of the bellows tubes 221 has several holes 2231 which are formed therethrough and several rounded protrusions 226 which project upward from the upper surface of the top wall 223 to abut against the covering 21 so as to provide a massage effect to a user. The bottom wall 224 of each of the bellows tubes 221 has a check valve 227 which communicates with a corresponding one of the holes 231 of the base plate 23 in order to prevent air in the bellows tube 221 from flowing out of the bellows tube 221 through the bottom wall 224 while permitting air to flow from the corresponding one of the holes 231 of the base plate 23 into the bellows tube 221 through the bottom wall 224. Each of the bellows tubes 221 further includes several L-shaped fastening rods 229 which extend outward from the accordion-like peripheral wall 225 of the bellows tubes 221. The air permeable cushion 2 further includes a plurality of flexible U-shaped connection rods 228 (only one can be seen). Each of the connection rods 228 has two hook-like end portions which are respectively attached to the fastening rods 229 of an adjacent pair of the bellows tubes 221 so as to position the spring units 22 on the base plate 23. When pressure is applied on the covering 21, the bellows tubes 221 contract, thereby causing air to flow though the covering 21 via the holes 2231 of the top wall 223. Accordingly, when the user lies, sits, or rests on the covering 21 of the air permeable cushion 2, he or she feels cool and comfortable. When the pressure applied on the covering 21 is released, the bellows tubes 221 expand by the action of the coiled compression spring 222, thereby sucking in air via the check valve 227 of the bottom wall 224 and the holes 2231 of the top wall 223. Accordingly, the spring units 22 enable air to be circulated within the air permeable cushion 2.

Figure 4:
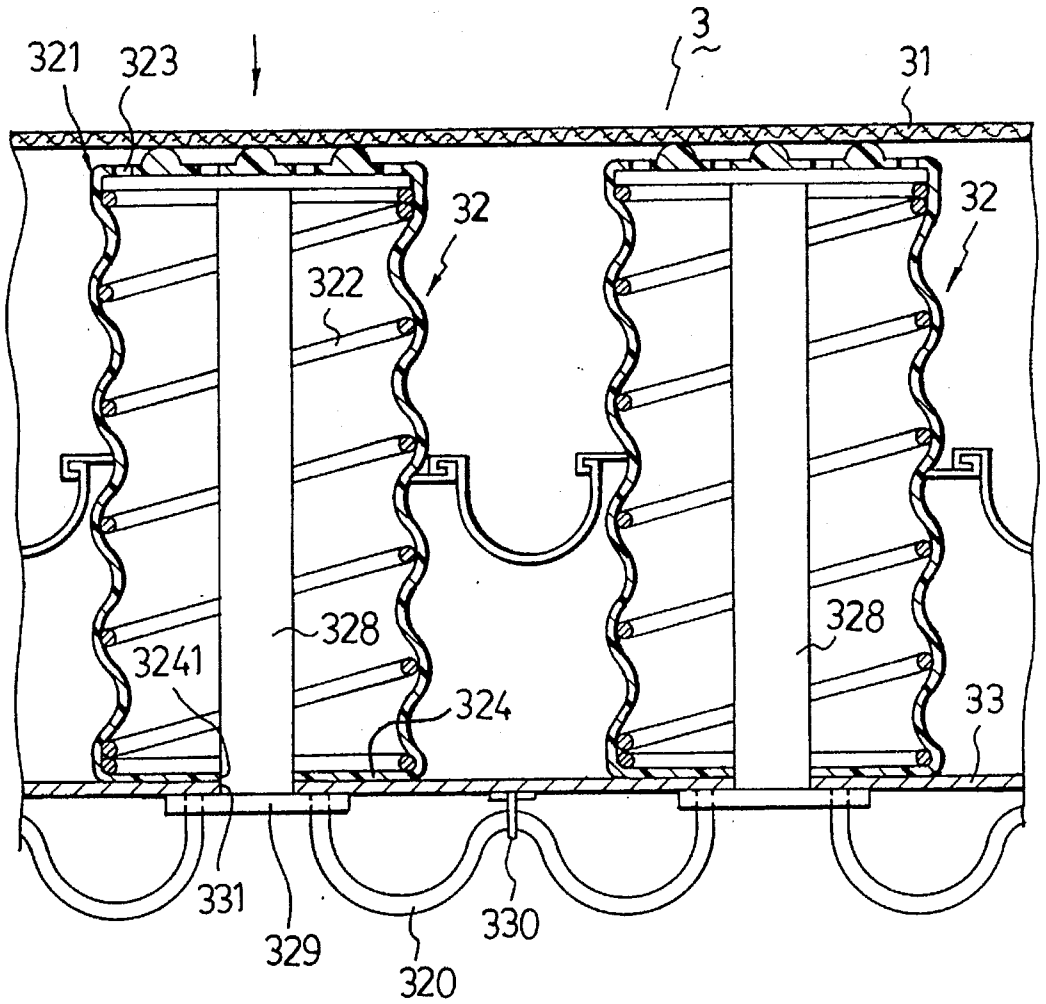
FIG. 4 is a sectional view showing the second embodiment of the air permeable cushion of this invention.

Referring to FIG. 4, an air permeable cushion 3 of the second embodiment of this invention includes a horizontal base plate 33, a plurality of spring units 32 which are erected on the base plate 33 and which are positioned on the base plate 33 in the same manner as the first embodiment, and an upper covering 31 which is disposed on the spring units 32 and which envelops the spring units 32 therein.

The upper covering 31 is made of an air permeable cloth. The base plate 33 has several holes 331 formed therethrough. Each of the spring units 32 includes a bellows tube 321 and a coiled compression spring 322 which is mounted within the bellows tube 321. The bellows tubes 321 are similar to those of the first embodiment in construction except for the horizontal bottom walls 324 of the bellows tubes 321. The bottom wall 324 of each of the bellows tubes 321 has a positioning hole 3241 formed therethrough and is still provided with a check valve (not shown) which is in function similar to the first embodiment. Each of the bellows tubes 321 further includes a column 328 which is mounted securely on the top wall 323 of the bellows tube 321 at the upper end thereof and which extends downward through the positioning hole 3241 of the bottom wall 324 and the corresponding one of the holes 331 of the base plate 33, and a horizontal connection plate 329 which is mounted securely on the bottom end of the column 328 and which abuts against the bottom surface of the base plate 33. The air permeable cushion 3 further includes a plurality of generally W-shaped flexible bars 320 (only one can be seen) which function as lever elements, and a plurality of loop elements 330 which are mounted securely on the bottom surface of the base plate 33. Each of the W-shaped flexible bars 320 has a first end and a second end that are connected respectively to an adjacent pair of the connection plates 329. The middle portion of each of the W-shaped flexible bars 320 extends through and is held on the respective one of the loop elements 330. Each of the loop elements 330 functions as a fulcrum for the corresponding one of the lever elements. Either of the first and second ends of each of the W-shaped flexible bars 320 is capable of being depressed to raise the other of the first and second ends of the W-shaped flexible bar 320. Accordingly, when one of the spring units 32 is depressed so as to move downward, the column 328, the connection plate 329, and the first end of the corresponding one of the W-shaped flexible bars 320 is pushed downward. At this time, the second end of the corresponding W-shaped flexible bar 320 rises so as to lift the other one of the spring units 32 which is connected to the second end of the corresponding W-shaped flexible bar 320. Thus, leverage between an adjacent pair of the spring units 32 is achieved so as to fit the figure of the user. As a result, when the user lies, sits, or rests on the covering 31 of the air permeable cushion 3, the air permeable cushion 3 is capable of providing the user with a cool and comfortable feeling.

With this invention thus explained, it is apparent that numerous modifications and variations can be made without departing from the scope and spirit of this invention. It is therefore intended that this invention be limited only as indicated in the appended claims.

I claim:

1. An air permeable cushion including a horizontal base plate, a plurality of spring units erected on said base plate, and an upper covering disposed on said spring units and enveloping said spring units therein, wherein the improvement comprises:

said base plate having several holes formed therethrough;

said covering being made of an air permeable cloth;

each of said spring units including:

a bellows tube being made of a flexible material and having a horizontal bottom wall which abuts against said base plate and which has a check valve communicated with a corresponding one of said holes of said base plate in order to prevent air in said bellows tube from flowing out of said bellows tube through said bottom wall while permitting air to flow from said corresponding one of said holes of said base plate into said bellows tube through said bottom wall, a horizontal top wall which abuts against said covering and which has several holes formed therethrough, and an accordion-like peripheral wall which interconnects said top and bottom walls so that, when pressure is applied on said covering, said bellows tube contracts, thereby causing air to flow through said covering via said holes of said top wall;

a coiled compression spring mounted within said bellows tube so that when said pressure applied on said covering is released, said bellows tube expands by action of said spring, thereby sucking in air via said check valve and said holes of said top wall; and a plurality of flexible U-shaped connection rods, each of said connection rods having two end portions respectively attached to an adjacent pair of said bellows tubes so as to position said spring units on said base plate.

2. An air permeable cushion including a horizontal base plate, a plurality of spring units erected on said base plate, and an upper covering disposed on said spring units and enveloping said spring units therein, wherein the improvement comprises:

said base plate having several holes formed therethrough;

said covering being made of an air permeable cloth;

each of said spring units including:

a bellows tube being made of a flexible material and having a horizontal bottom wall which abuts against said base plate and which has a check valve communicated with a corresponding one of said holes of said base plate in order to prevent air in said bellows tube from flowing out of said bellows tube through said bottom wall while permitting air to flow from said corresponding one of said holes of said base plate into said bellows tube through said bottom wall, a horizontal top wall which abuts against said covering and which has several holes formed therethrough, and an accordion-like peripheral wall which interconnects said top and bottom walls so that, when pressure is applied on said covering, said bellows tube contracts, thereby causing air to flow through said covering via said holes of said top wall;

a coiled compression spring mounted within said bellows tube so that when said pressure applied on said covering is released, said bellows tube expands by action of said spring, thereby sucking in air via said check valve and said holes of said top wall; and wherein said bellows tube of each of said spring units has several rounded protrusions projecting upward from an upper surface of said top wall of said bellows tube so as to abut against said covering and provide a massage effect to a user.

3. An air permeable cushion including a horizontal base plate, a plurality of spring units erected on said base plate, and an upper covering disposed on said spring units and enveloping said spring units therein, wherein the improvement comprises;

said base plate having several holes formed therethrough;

said covering being made of an air permeable cloth;

each of said spring units including:

a bellows tube being made of a flexible material and having a horizontal bottom wall which abuts against said base plate and which has a check valve communicated with a corresponding one of said holes of said base plate in order to prevent air in said bellows tube from flowing out of said bellows tube through said bottom wall while permitting air to flow from said corresponding one of said holes of said base plate into said bellows tube through said bottom wall, a horizontal top wall which abuts against said covering and which has several holes formed therethrough, and an accordion-like peripheral wall which interconnects said top and bottom walls so that, when pressure is applied on said covering: said bellows tube contracts, thereby causing air to flow through said covering via said holes of said top wall:

a coiled compression spring mounted within said bellows tube so that when said pressure applied on said covering is released, said bellows tube expands by action of said spring, thereby sucking in air via said check valve and said holes of said top wall; and wherein each of said bellows tubes further has a positioning hole formed through said bottom wall, a column mounted securely on said top wall of said bellows tube at an upper end thereof and extending downward through said positioning hole of said bellows tube and through a corresponding one of said holes of said base plate, and a horizontal connection plate mounted securely on a bottom end of said column and abutting against a bottom surface of said base plate, said air permeable cushion further including a plurality of lever elements, each of said lever elements including a curved flexible bar which has a first end and a second end that are respectively connected to an adjacent pair of said connection plates, either of said first and second ends of each of said bars being capable of being depressed to raise the other of said first and second ends of said bar.

4. An air permeable cushion including a horizontal base plate, a plurality of spring units erected on said base plate, and an upper covering disposed on said spring units and enveloping said spring units therein, wherein the improvement comprises:

said base plate having several holes formed therethrough;

said covering being made of an air permeable cloth;

each of said spring units including:

a bellows tube being made of a flexible material and having a horizontal bottom wall which abuts against said base plate and which has a check valve communicated with a corresponding one of said holes of said base plate in order to prevent air in said bellows tube from flowing out of said bellows tube through said bottom wall while permitting air to flow from said corresponding one of said holes of said base plate into said bellows tube through said bottom wall, a horizontal top wall which abuts against said covering and which has several holes formed therethrough, and an accordion-like peripheral wall which interconnects said top and bottom walls so that, when pressure is applied on said covering: said bellows tube contracts, thereby causing air to flow through said covering via said holes of said top wall;

a coiled compression spring mounted within said bellows tube so that when said pressure applied on said covering is released, said bellows tube expands by action of said spring, thereby sucking in air via said check valve and said holes of said top wall;

wherein each of said bellows tubes further has a positioning hole formed through said bottom wall, a column mounted securely on said top wall of said bellows tube at an upper end thereof and extending downward through said positioning hole of said bellows tube and through a corresponding one of said holes of said base plate, and a horizontal connection plate mounted securely on a bottom end of said column and abutting against a bottom surface of said base plate, said air permeable cushion further including a plurality of lever elements, each of said lever elements including a curved flexible bar which has a first end and a second end that are respectively connected to an adjacent pair of said connection plates, either of said first and second ends of each of said bars being capable of being depressed to raise the other of said first and second ends of said bar; and wherein said flexible curved bar of each of said lever elements is W-shaped.

5. An air permeable cushion including a horizontal base plate, a plurality of spring units erected on said base plate, and an upper covering disposed on said spring units and enveloping said spring units therein, wherein the improvement comprises:

said base plate having several holes formed therethrough;

said covering being made of an air permeable cloth;

each of said spring units including:

a bellows tube being made of a flexible material and having a horizontal bottom wall which abuts against said base plate and which has a check valve communicated with a corresponding one of said holes of said base plate in order to prevent air in said bellows tube from flowing out of said bellows tube through said bottom wall while permitting air to flow from said corresponding one of said holes of said base plate into said bellows tube through said bottom wall, a horizontal top wall which abuts against said covering and which has several holes formed therethrough, and an accordion-like peripheral wall which interconnects said top and bottom walls so that, when pressure is applied on said covering, said bellows tube contracts, thereby causing air to flow through said covering via said holes of said top wall;

a coiled compression spring mounted within said bellows tube so that when said pressure applied on said covering is released, said bellows tube expands by action of said spring, thereby sucking in air via said check valve and said holes of said top wall;

wherein each of said bellows tubes further has a positioning hole formed through said bottom wall, a column mounted securely on said top wall of said bellows tube at an upper end thereof and extending downward through said positioning hole of said bellows tube and through a corresponding one of said holes of said base plate, and a horizontal connection plate mounted securely on a bottom end of said column and abutting against a bottom surface of said base plate, said air permeable cushion further including a plurality of lever elements, each of said lever elements including a curved flexible bar which has a first end and a second end that are respectively connected to an adjacent pair of said connection plates, either of said first and second ends of each of said bars being capable of being depressed to raise the other of said first and second ends of said bar;

wherein said flexible curved bar of each of said lever elements is W-shaped; and wherein said base plate has a plurality of loop elements mounted securely on said bottom surface thereof, each of said W-shaped bars having a middle portion extending through and being held on a respective one of said loop elements so that said loop elements function as fulcrums of said lever elements.

* * * * *